United States Patent [19]

Broersma

[11] Patent Number: 4,901,373

[45] Date of Patent: Feb. 20, 1990

[54] HELMET RETENTION SYSTEM WITH ADJUSTABLE BUCKLE

[75] Inventor: Lester V. Broersma, Bellflower, Calif.

[73] Assignee: Bell Helmets, Inc., Norwalk, Calif.

[21] Appl. No.: 164,852

[22] Filed: Mar. 7, 1988

[51] Int. Cl.[4] ..... A42B 7/00; A63B 71/10

[52] U.S. Cl. ..... 2/421; 2/425; 24/200

[58] Field of Search ..... 24/172, 198, 200, 315; 2/410, 411, 421, 425

[56] References Cited

U.S. PATENT DOCUMENTS

| | | | |
|---|---|---|---|
| 1,440,403 | 1/1923 | Miller et al. | 24/198 |
| 2,316,846 | 4/1943 | Diebold | 24/200 |
| 3,146,462 | 9/1964 | Militello | 2/410 |
| 3,192,588 | 7/1965 | White | 24/200 |
| 3,336,639 | 8/1967 | Rutty et al. | 24/200 |
| 3,501,772 | 3/1970 | Wyckoff | 2/421 |
| 4,044,400 | 8/1977 | Lewicki et al. | 2/421 |
| 4,171,555 | 10/1979 | Bakker | 24/200 |
| 4,279,037 | 7/1981 | Morgan | 2/421 |
| 4,387,490 | 6/1983 | Blackburn et al. | 24/200 |
| 4,395,803 | 8/1983 | Krauss | 24/200 |
| 4,445,253 | 5/1984 | Howey | 2/421 X |
| 4,461,044 | 7/1984 | Reiterman et al. | 2/421 |
| 4,525,901 | 7/1985 | Krauss | 24/200 |
| 4,571,783 | 2/1986 | Kasai | 24/200 |
| 4,622,700 | 11/1986 | Sundahl | 2/425 |
| 4,637,099 | 1/1987 | Kasai | 24/200 |

*Primary Examiner*—W. Carter Reynolds

*Attorney, Agent, or Firm*—William W. Haefliger

[57] ABSTRACT

A helmet retention system includes a junction plate which, when tilted relative to the wearer's cheek, loosens its grip, on a chin strap. The plate is attached to a strap or straps which are in turn attached to the helmet. The plate has a triangular cross section cross piece with narrow lands having edges normally gripping the chin strap. Also, the helmet has a lower outer side which loops about the helmet and is shaped to grip a replaceable textile band, which is decorative.

13 Claims, 5 Drawing Sheets

3
3
2
2
63
12
11a
174
175
173
11
171
70
62
69
11b
178
178a
12
16
13
17
77
14
79
78
110
111
15

69
181
69a
62
70
178
180

173
69
172
62
69
16a,17a
66
64
65
70
2a
11
178
16
17

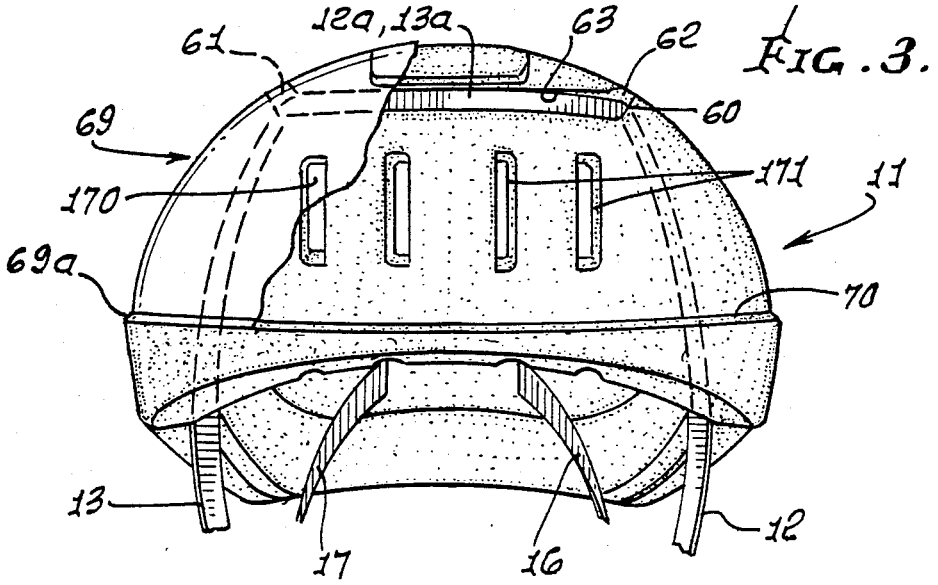
FIG. 3.
FIG. 5.
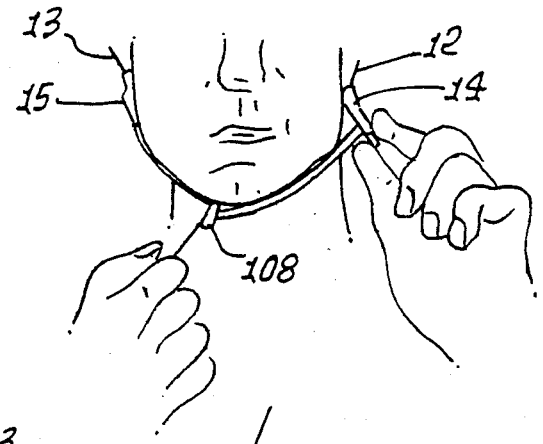
FIG. 4.
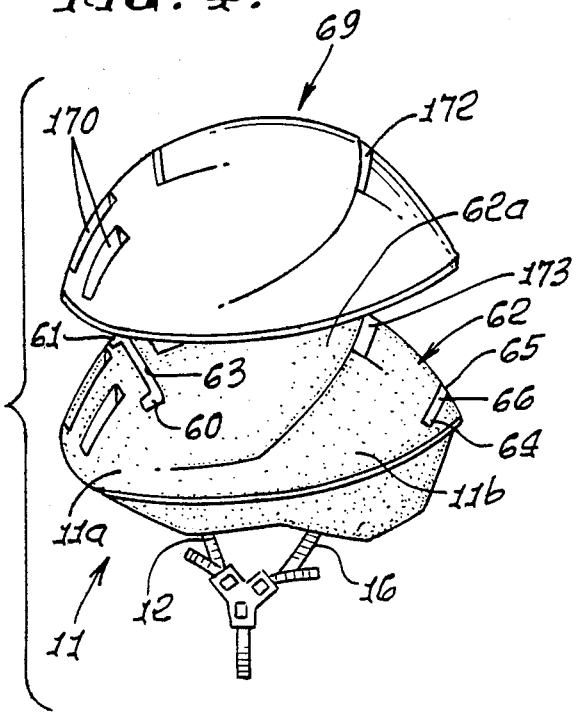
FIG. 6.
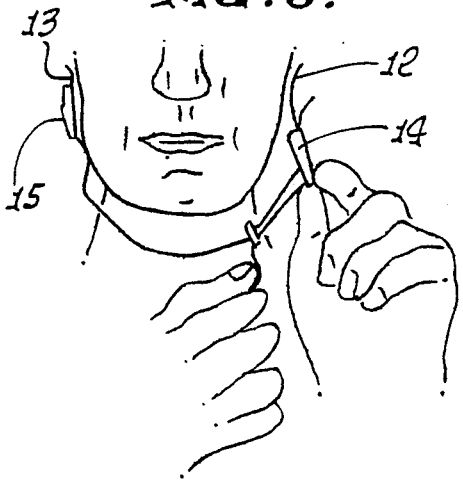

HELMET RETENTION SYSTEM WITH ADJUSTABLE BUCKLE

BACKGROUND OF THE INVENTION

This invention relates generally to bicycle helmet retention, and more particularly concerns improvements in chin strap junction plates; and in chin strap connection to helmets and their conformability to wearers, including quick connection and dis-connection and ready adjustability. This invention improves upon the invention of U.S. Pat. No. 4,461,044.

There is continuing need for a bicycle or motorcycle helmet retention harness having the following characteristics:

(1) means for quick one-handed connection, as well as disconnection, obviating need for repeated adjustment of harness webs or straps each time the helmet is worn;

(2) conformability of the junction plate connections or clips to the angle of the wearer's jaw;

(3) construction of strap connections to allow back-strap location well under the earlobes;

(4) construction of strap junction plate connections permitting positive connection of the straps to the helmet;

(5) adjustability of helmet straps to junction plates while preventing unwanted strap slippage; and (6) loosening adjustment of a chin strap achieved merely by tilting of a junction plate.

SUMMARY OF THE INVENTION

It is a major object of the invention to provide an improved harness, satisfying the above needs.

Basically, the system includes:

(a) a strap supporting shell, (b) a chin strap, (c) webbing connected to the shell and extending downwardly beneath left and right sides of the shell, (d) and means interconnecting the chin strap with said webbing, and including chin strap gripping junction plate means through which the chin strap extends in looping configuration, the plate means configured to loosen its grip on the chin strap when tilted relative to the face of the wearer.

Accordingly, very easy and quick adjustment of the chin strap or web, and thus the entire harness, to the wearer's face, may be achieved merely by tilting of a junction plate, such as at the left side of the wearer's face.

Typically, the junction plate has two openings and a cross piece between the openings, the chin strap looping about the cross-piece and extending through said openings, the cross piece having triangular cross section with narrow lands having edges gripping the chin strap. Those edges relieve the chin strap when the plate is tilted away from the wearer's face; and a third edge providing strap gripping land edges may also be provided on the plate, as will be seen.

It is another object of the invention to provide a lightweight plastic foam shell that positively retains left and right straps that pass through pairs of openings in the shell; as well a protective, thin, lightweight outer shell that seats upon and adheres to the thicker, strap retaining shell, and in such manner as to cover the strap passing openings. In addition, the construction of the thicker shell is such as to facilitate application of an elastic band looping about outstanding looping extent of the shell lower portions, whereby bands of different color or design may be selectively applied to such helmets, as desired.

Also, the positive connections of the straps or webs to the helmet, proximate the uppermost domed extent thereof, causes the left and right straps to engage the side of the wearer's face, whereby the left and right junction plates also flatly engage the side of the wearer's face. This, in turn, facilitates controlled tilting of one of the junction plates, as will be described, with a plate fulcrum engaging the wearer's face, to achieve controlled chin strap adjustment, in a very simple manner, whereby the wearer can easily adjust his helmet with one hand, during cycling, and he need not try to adjust the straps themselves to achieve such adjustment.

These and other objects and advantages of the invention, as well as the details of an illustrative embodiment, will be more fully understood from the following specification and drawings, in which:

DRAWING DESCRIPTION

Figure 1:
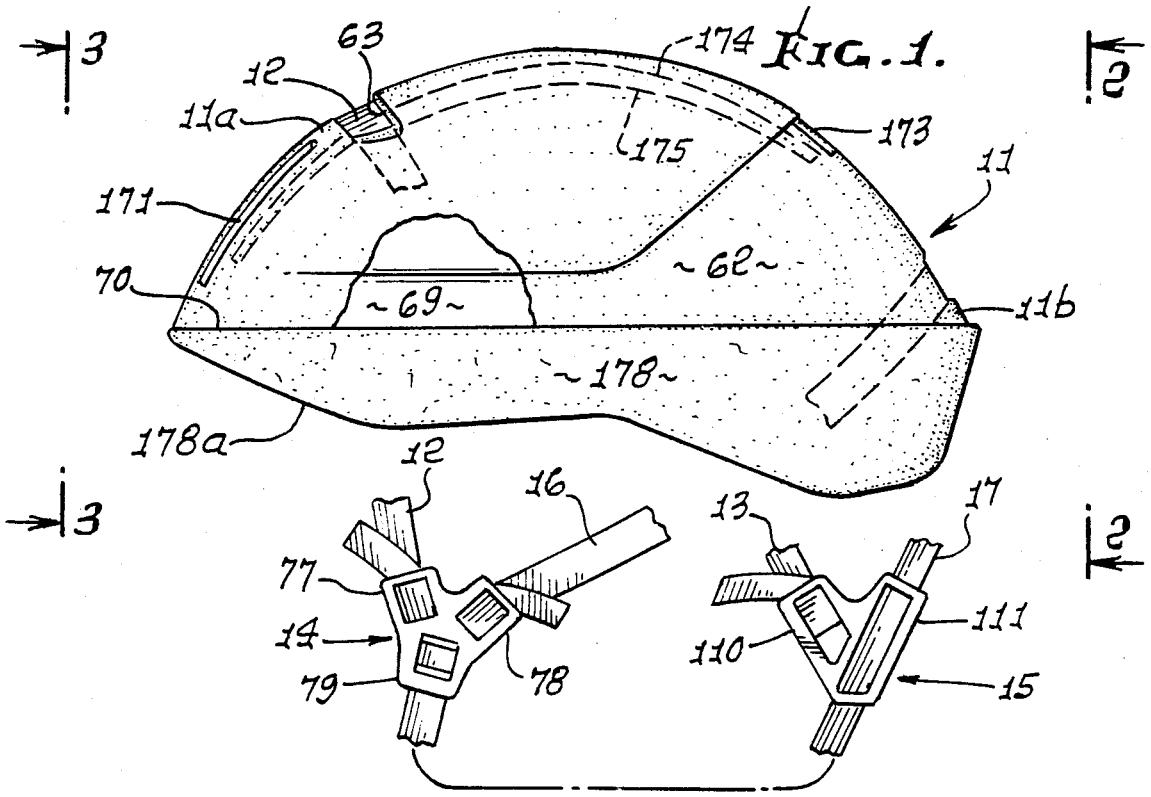
FIG. 1 is a left side view of a helmet system incorporating the invention.
Figure 2A:
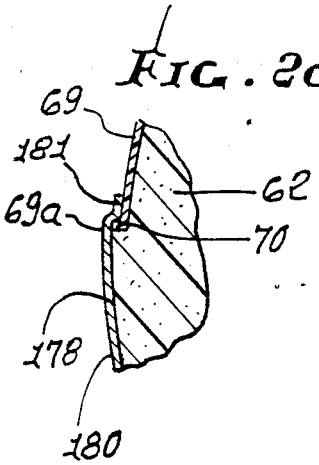
FIG. 2 is a rear elevation taken on lines 2—2 of FIG. 1.
Figure 2:
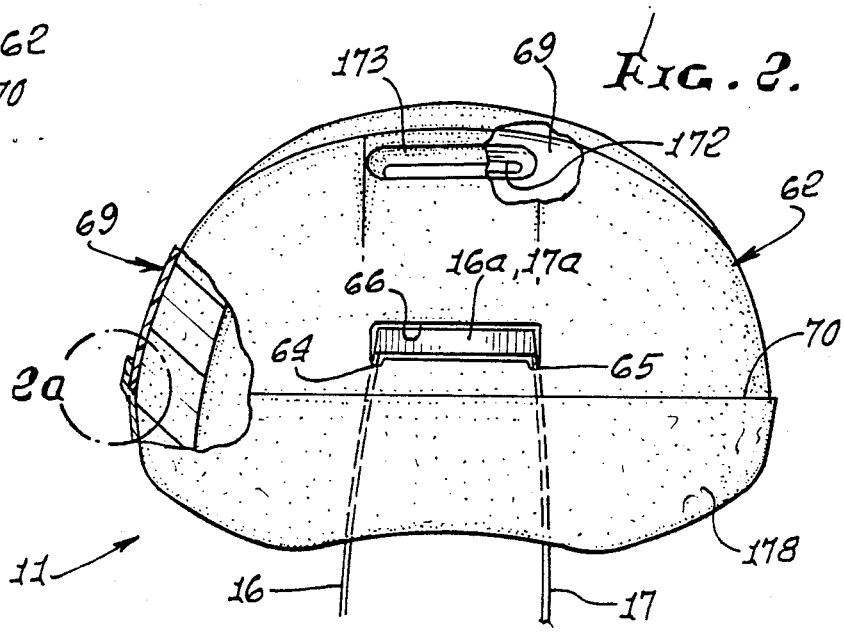
Figure 7:
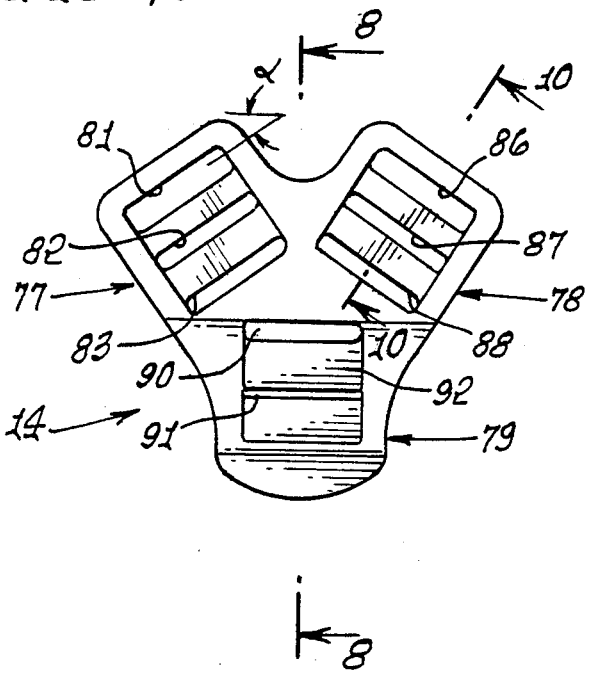
Figure 9:
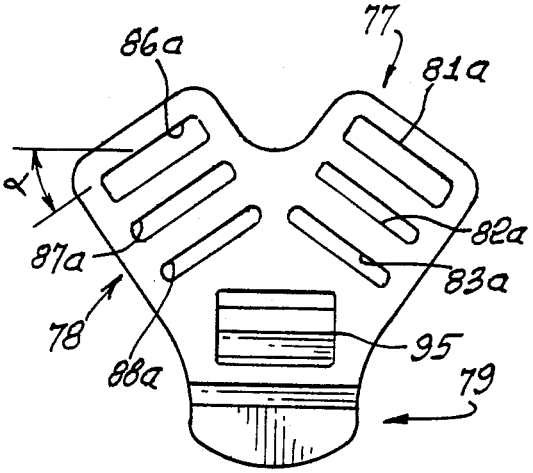
Figure 10:
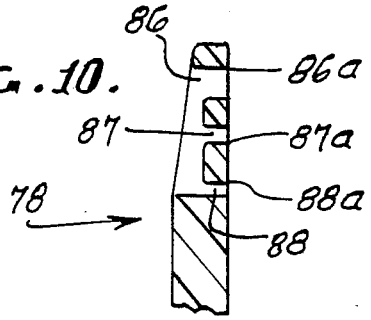
Figure 8:
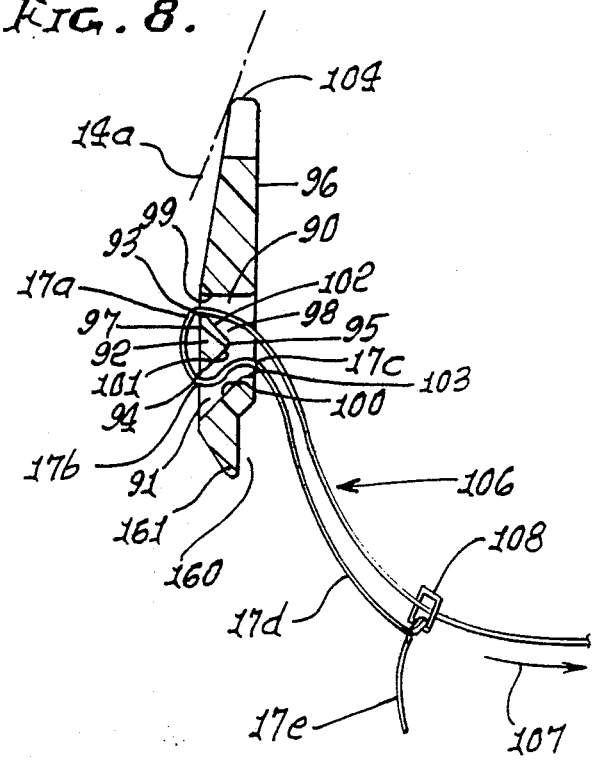
Figure 17:
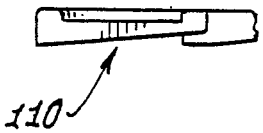
Figure 18:
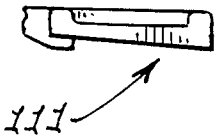
Figure 11:
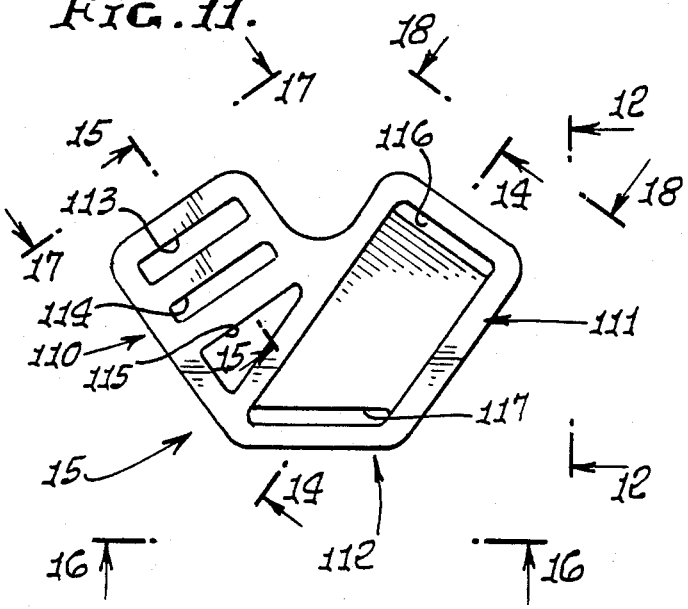
Figure 12:
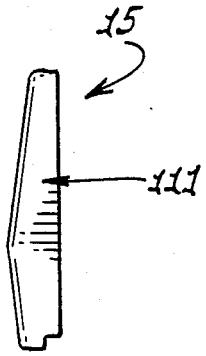
Figure 13:
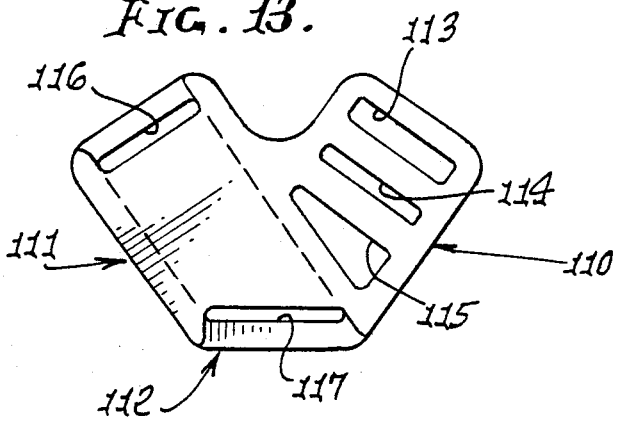
Figure 14:
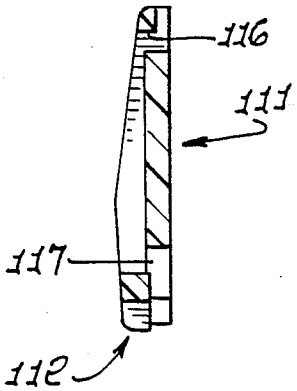
Figure 16:
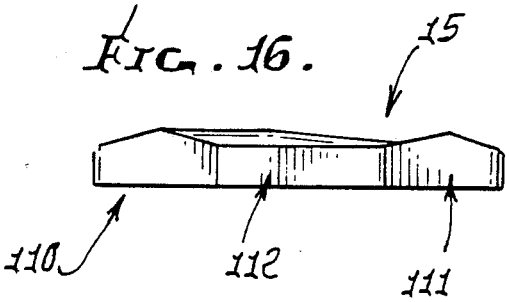
Figure 15:
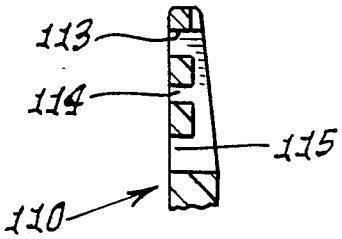
Figure 20:
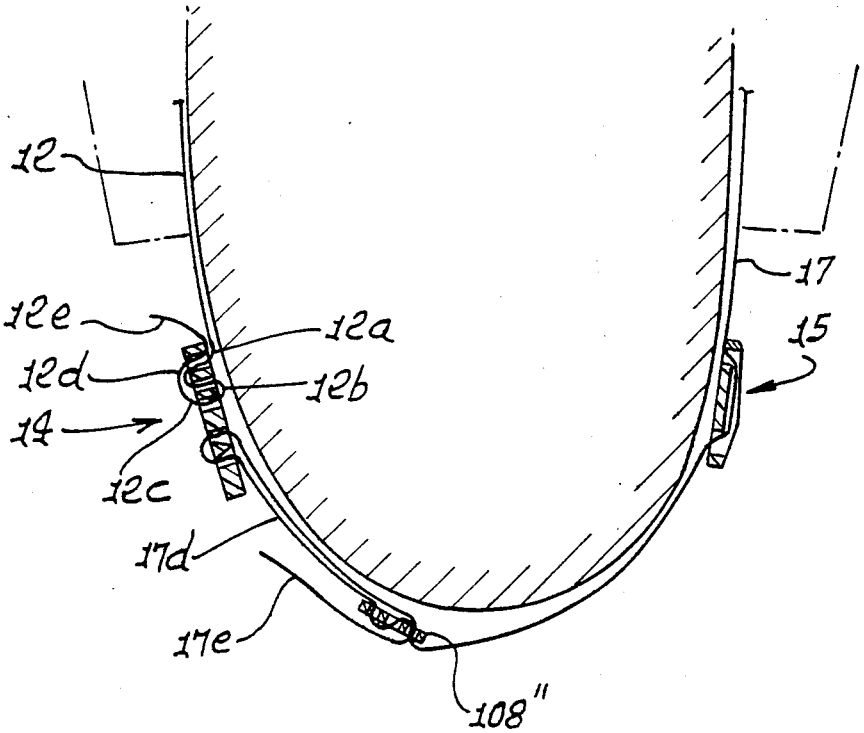
Figure 19:
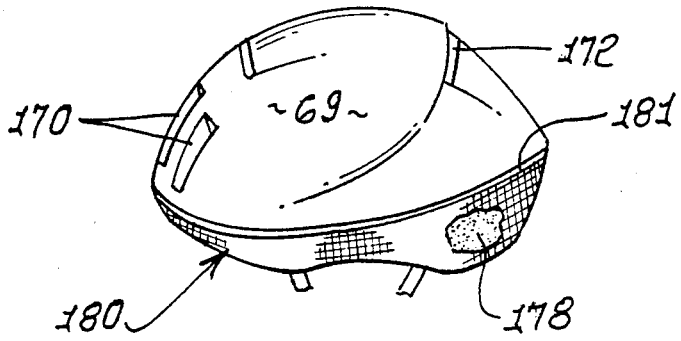

FIG. 2*a* is an enlarged fragmentary section on lines 2*a*—2*a* of FIG. 2, partly broken away to show interior construction;

FIG. 3 is a front elevation on lines 3—3 of FIG. 1, partly broken away to show detailed construction;

FIG. 4 is a perspective exploded view showing liner and lightweight outer shell elements;

FIGS. 5 and 6 are front elevations showing the helmet retention system in tightening and loosening modes;

FIG. 7 is an enlarged front (outer side) elevation showing a retention system left side junction plate;

FIG. 8 is a section in elevation on lines 8—8 of FIG. 7;

FIG. 9 is a rear elevational view of the FIG. 7 clip;

FIG. 10 is an enlarged section taken on lines 10—10 of FIG. 7;

FIG. 11 is an enlarged front (outer side) elevation showing a retention system right side junction plate;

FIG. 12 is a side elevation on lines 12—12 of FIG. 11;

FIG. 13 is a rear elevation showing the FIG. 11 plate;

FIG. 14 is a section on lines 14—14 of FIG. 11;

FIG. 15 is a section on lines 15—15 of FIG. 11;

FIGS. 16–18 are views taken on lines 16—16, 17—17, and 18—18, respectively, of FIG. 11;

FIG. 19 is a side elevation showing a selectively colored band applied to the helmet of FIGS. 1–3; and FIG. 20 is a vertical section showing the retention system, viewed forwardly.

DETAILED DESCRIPTION

FIGS. 4–6 show the provision of a retention system or harness for a lightweight helmet 11. The system comprises left and right retention strap sections 12 and 13 attached to the helmet forward extent 11*a*; left and right junction plates 14 and 15 (see FIGS. 7 and 11) respectively attached to the strap sections 12 and 13 (as illustrated in FIG. 1 for section 14); and rear strap sections 16 and 17 attached to the helmet rearward extent 11*b*. In FIG. 1, the plate 15 is shown shifted out of position, for visibility.

The strap sections 12 and 13 extend upwardly and inwardly into the helmet upwardly domed interior, and then through perforations 60 and 61 in the helmet thicker shell 62, and extend across the outer upper side of that shell, in a lateral recess 63. See FIG. 3. The two strap sections merge together at 12*a* and 13*a* and are then joined. The rear strap sections 16 and 17 likewise extend upwardly and rearwardly into the helmet interior, and then through perforations 64 and 65 in the helmet shell 62, and extend across the outer rear side of the shell, in a lateral recess 66. See FIG. 2. The two strap sections merge together as at 16*a*, 17*a* and are then joined.

After the strap sections 12 and 13, and 16 and 17 are installed in the helmet shell as described, a thin, very lightweight outer shell 69 (see FIG. 4) is fitted down over the dome 62*a* of shell 62, and attached in place, as by adhesive bonding, to cover the recesses 63 and 66 and the strap extents therein.

A protected positive connection of the strap sections to the thicker, lightweight yet strong shell 62 is thereby provided. Shell 62 may consist of PVC resin (rigid foam) for example. FIGS. 2, 2*a* and 3 show the lower peripheral lip bead 69*a* on outer shell 69 fitted downwardly against stop or locating shoulder 70 provided or formed by the shell 62. Shoulder 70 extends in oval shape or loop configuration about the lower extent of the shell 69 and forms an upward facing ledge.

Referring now to FIGS. 7–10, means in the form of the left junction plate 14 is provided for interconnecting a chin strap with the left side strap or webbing elements 12 and 16. The plate 14 has first, second and third attachment structures 77–79 which are integrally interconnected, as by molding in the form of a one-piece plastic unit. Structure 77 includes multiple generally forwardly extending slots in which one of the left and right strap sections is threaded, for strap length adjustment and plate retention. Three such slots are shown at 81–83, extending in parallel relation, forwardly and downwardly, at angle $\alpha$ from horizontal. Angle $\alpha$ is between 30° and 40° (and preferably about 35°) to conform the strap to the helmet and to the face and jaw of the wearer, and also to accomodate functioning of the plate, to be described.

FIG. 20 shows strap section 12 passing at 12*a* from the inside to the outside of upper slot 81, then downwardly and passing at 12*b* from the outside to the inside of middle slot 82, then passing downwardly and outwardly at 12*c* from the inside to the outside of lower slot 83; then passing upwardly and inwardly at 12*d* from the outside to the inside of upper slot 81; and then extending freely upwardly as a tab 12*e*, for finger gripping and adjustment. Slot 81 has sharp upper and inner edges at 81*a* and 81*b* to pinch strap portions 12*a* and 12*d* preventing slip. See also inner edges 82*a* and 83*a* to grip the strap.

A similar construction is imparted to attachment structure 78, as exemplified by parallel slots 86–88 (corresponding in function and structure to slots 81–83), to retain strap section 16. Note sharp inner edges 86*a*, 87*a* and 88*a* to grip the strap, these edges corresponding to edges 81*a*, 82*a* and 83*a*. Slots 86–88 extend rearwardly and downwardly at angle $\alpha$ from horizontal, where $\alpha$ is between 30° and 40°, and is preferably about 35°.

The third attachment structure 79 projects downwardly and defines two parallel through slots 90 and 91 that extend generally forwardly and rearwardly, one above the other. See FIG. 8. A cross piece 92 extends between and separates these two slots or openings, and it has a generally triangular cross section with narrow flats 93 and 94 at its upper and lower edges, and a sharp inwardly projected apex at 95. That apex terminates approximately mid-way between vertical planes defined by inner and outer faces 96 and 97 of the plate 14; thus, slots 90 and 91 merge in region 98, between faces 97 and 96, but closer to the latter. Note also horizontal upper guide surface 99 of slot 90, and upwardly and inwardly angled lower guide surface 100 of slot 91. Surface 100 is parallel to the lower surface 101 of the triangular cross piece, both extending at about 45° to horizontal, as shown. Angled lower and upper surfaces 101 and 102 of the cross-piece converge toward apex 95; angled surface 100 terminates at narrow flat 103. Flats 93, 94 and 103 have dual parallel sharp edges, as shown, providing six chin strap engaging and retention edges. Note that strap 17 has looping portions 17*a*, 17*b*, and 17*c* that engage those six edges when strap section 17*d* is pulled in direction 107 to tighten the strap, holding plate 14 against the left side of the user's face. A glide ring 108 is attached to the end portion of strap section 17*d*, and passes the strap 17, to glide therealong, when the user grips end 17*e*, and pulls it in direction 107.

Conversely, the construction is such that when the plate is tilted outwardly away from the user's face and about fulcrum 104, and to a plane near that as is indicated at 14*a*, the edges of the narrow flats 93, 94 and 103 are sufficiently relieved from engagement with the strap loop or looping portions that the strap loosens automatically, and strap section 17*d* travels back toward the plate to an extent corresponding to such loosening, which corresponds to tilting of the plate, as described. Thus, a quick and ready adjustment of the chin strap tightness is achieved by the degree of easy manual tilting of the junction plate. Lower inner extent of the plate is relieved at 160, to provide an outstanding lower projection 161 which may be readily grasped by the user's fingers, to tilt the plate as described.

FIGS. 1 and 11–16 show the right side junction plate 15 which has strap retention structures 110, 111 and 112. Structure 110 has the same slot construction as structure 77, and retains strap 13 in the same manner that structure 77 retains strap 12. See slots 113–115 of structure 110, like slots 81–83 of structure 77. Structure 111 has only one slot 116, corresponding for example to slot 86 of structure 78, and it simply passes strap 17, which then extends downwardly through in structure 112 as seen in FIG. 1. Strap 17 may extend to and through a suitable glide, as shown at 108 in FIG. 8, and at 108" in FIG. 20.

The outer thin shell 69 contains or defines four vertical air inlet openings 170 which register with corresponding air inlet openings 171 in the front side of shell 62. (See FIGS. 1, 3, and 19). Likewise, the outer shell 69 contains or defines one horizontal and lateral air discharge opening 172 which registers with corresponding air discharge opening 173 in the rear wall of shell 62. Front to rear slots in the upper interior foam of shell 69 (and between broken lines 174 and 175 in FIG. 1) pass inlet air from inlet slots 170 and 171 to outlet slots 172 and 173, for ventillating purposes.

The laterally exposed lower looping side wall extent 178 of shell 62 defines a looping, laterally outstanding surface to support a decorative band 180 (see FIG. 19 and FIG. 2*a*). That band extends in a loop, and is elastic to stretch over and cling to the side surface 178. Also, the band has an upper edge 181 fits over bead 69*a* of thin shell 69, for retaining the band in position; also, the lower edge of the band curls beneath the lower edge 178*a* of shell 62, to assist in retaining the band in position. The band and lower extent 178 are generally forwardly wedge shaped. Thus, the band hugs the shell 62 and becomes a part of the helmet.

Accordingly, the helmet wearer can select which decorative band he may want to wear on his helmet, at any time, i.e. choose a band having a color to match his or her sports wear for that day, and replace the band with another of a different design or color, for a different occasion. This give the appearance effect of having a different helmet, one for each occasion, but without incurring the cost of a large number of complete helmets.

Slide 108 may have one opening as seen, in FIG. 8, or two parallel elongated openings as seen at 108″ in FIG. 20, to pass strap 17.

I claim:

1. In a helmet retention system, the combination comprising:

(a) a strap supporting shell, (b) a chin strap, (c) webbing connected to the shell and extending downwardly beneath left and right sides of the shell, (d) and means interconnecting the chin strap with said webbing, and including chin strap gripping junction plate means through which the chin strap extends in looping configuration, the plate means configured to loosen its grip on the chin strap when tilted relative to the face of the wearer, (e) and including a lightweight, thin, plastic outer shell adhered downwardly upon upper extent of the strap supporting shell, the strap supporting shell defining an upward facing ledge that seats the lower rim of the outer shell, in looping configuration.

2. The combination of claim 1 wherein the junction plate means has two openings and a cross piece between the openings, the chin strap looping about the cross piece and extending through said openings, the cross piece having triangular cross section with narrow lands having edges gripping the chin strap.

3. The combination of claim 2 including a loop shaped slide defining at least one opening through which the chin strap extends.

4. The combination of claim 3 wherein the slide has one opening.

5. The combination of claim 3 wherein the slide has two parallel openings.

6. The combination of claim 1 wherein the shell has a front pair of openings to pass a front section of the webbing, and a rear pair of holes to pass a rear section of the webbing.

7. The combination of claim 1 wherein the strap supporting shell defines a looping, outstanding lower side surface, and including a decorative band extending about the strap support shell adjacent said outstanding side surface.

8. In a helmet retention system, the combination comprising:

(a) a strap supporting shell, (b) a chin strap;

(c) webbing connected to the shell and extending downwardly beneath left and right sides of the shell, (d) and means interconnecting the chin strap with said webbing, and including chin strap gripping junction plate means through which the chin strap extends in looping configuration, the plate means configured to loosen its grip on the chin strap when tilted relative to the face of the wearer, (e) and including a lightweight, thin, plastic outer shell adhered downwardly upon upper extent of the strap supporting shell, (f) the strap supporting shell defining an upward facing ledge that seats the lower rim of the outer shell, in looping configuration, the strap supporting shell defining a looping, outstanding, lower side surface, and including a decorative band extending about the strap support shell adjacent said outstanding side surface, the band consisting of fabric and having elastic construction.

9. In a helmet system, the combination comprising:

(a) relatively thick, rigid foam plastic shell having helmet shape, the shell having an upwardly domed upper extent, and a lower side extent which faces outwardly and loops about the shell interior, which is hollow to fit over the wearer's head, (b) a relatively thin outer shell having dome shape to fit closely over the domed upper extent of the foam plstic shell, and (c) a replaceable decorative elastic band extending in a loop, and huggingly fitting to the looping lower side extent of the foam plastic shell.

10. The system of claim 9 including a looping ledge on the foam shell which limits downward placement of the thin shell on the foam shell, and which provides a grip for the upper edge of the elastic band.

11. In a helmet retention system, the combination comprising:

(a) a strap supporting shell, (b) a chin strap, (c) webbing connected to the shell and extending downwardly beneath left and right sides of the shell, (d) and means interconnecting the chin strap with said webbing, and including chin strap gripping junction plate means through which the chin strap extends in looping configuration, the plate means configured to loosen its grip on the chin strap when tilted relative to the face of the wearer, (e) the junction plate means having two openings and a cross piece between the openings, the cross piece having triangular cross section with narrow lands having edges gripping the chin strap, (f) said junction plate means having a flat surface to flatly engage one side of the wearer's face, and including a second junction plate having a flat surface to flatly engage the opposite side of the wearer's face, said plates being Y-shaped, and said webbing having lower end portions retained to upper extents of the Y-shaped plates.

12. The combination of claim 11 wherein the strap supporting shell defines a looping, outstanding, lower side surface, and including a decorative band extending about the strap support shell adjacent said outstanding side surface.

13. In a helmet retention system, the combination comprising:

(a) a strap supporting shell, (b) a chin strap, (c) webbing connected to the shell and extending downwardly beneath left and right sides of the shell, (d) and means interconnecting the chin strap with said webbing, and including chin strap gripping junction plate means through which the chin strap extends in looping configuration, the plate means configured to loosen its grip on the chin strap when tilted relative to the face of the wearer, (e) the junction plate means having two openings and a cross piece between the openings, the chin strap looping about the cross piece and extending through said openings, the cross piece having triangular cross section with narrow bands having edges gripping the chin strap, (f) said junction plate means being Y-shaped, the webbing having lower end portions retained to upwardly projecting extent of the plate, and said cross-piece and openings being in the lower extent of the Y-shaped plate, the plate having a lower edge spaced from a plane defined by that side of the plate that engages the face of the user, thereby to define a finger grip to tilt the plate relative to the face of the user.

* * * * *